United States Patent [19]

Brunner et al.

[11] Patent Number: 4,703,524

[45] Date of Patent: Nov. 3, 1987

[54] CRIB

[75] Inventors: Merlin A. Brunner, New London; Harvey J. Draheim, Weyauwega; Glenn T. Charlson, Clintonville, all of Wis.

[73] Assignee: Simmons Universal Corporation, New York, N.Y.

[21] Appl. No.: 687,218

[22] Filed: Dec. 28, 1984

[51] Int. Cl.[4] ..... A47D 7/00; A47D 7/02

[52] U.S. Cl. ..... 5/93 R; 5/100; 292/37

[58] Field of Search ..... 5/93 R, 99 B, 100, 296–298, 5/27, 30; 292/37, 41

[56] References Cited

U.S. PATENT DOCUMENTS

| | | | |
|---|---|---|---|
| 1,174,652 | 3/1916 | Banks | 292/36 |
| 1,242,509 | 10/1917 | Zatzkin | 5/100 |
| 1,267,390 | 5/1918 | Dyke | 5/296 |
| 1,289,988 | 12/1918 | Whitcomb . | |
| 1,705,851 | 3/1929 | Bukolt | 5/100 |
| 2,234,261 | 3/1941 | Kroll et al. | 5/100 |
| 2,368,185 | 1/1945 | Webb . | |
| 2,418,680 | 4/1947 | Webb . | |
| 2,942,279 | 6/1960 | Von Canon, Jr. | 5/296 |
| 3,541,619 | 11/1970 | Morrison . | |
| 3,634,894 | 1/1972 | Harbison | 5/93 R |
| 3,636,571 | 1/1972 | Winer | 5/93 R |
| 3,646,622 | 3/1972 | Van Riper, Jr. | 5/100 |
| 3,786,524 | 1/1974 | Mathon . | |
| 3,896,514 | 7/1975 | Feldstein | 5/100 |
| 3,900,907 | 8/1975 | Mulder | 5/93 R |
| 3,933,330 | 1/1976 | Gwin | 297/27 |

FOREIGN PATENT DOCUMENTS

| | | | |
|---|---|---|---|
| 448459 | 5/1949 | Italy | 297/41 |

OTHER PUBLICATIONS

Simmons Juvenille Products Co. 1983 Catalog, p. 43.

*Primary Examiner*—Gary L. Smith
*Assistant Examiner*—Michael F. Trettel
*Attorney, Agent, or Firm*—A. Thomas Kammer

[57] ABSTRACT

A crib is provided including a drop side, a spring hanger, and stabilizing bars, all of which are mounted to common sets of tracks. The tracks are secured to the corner posts of the crib. The drop side includes an actuating mechanism including catch bars which are positioned within a groove in the upper rail thereof. The catch bars are maneuvered by an actuating member located near the center of the upper rail. Safety features are provided to prevent accidental lowering of the drop side.

12 Claims, 8 Drawing Figures

FIG 7
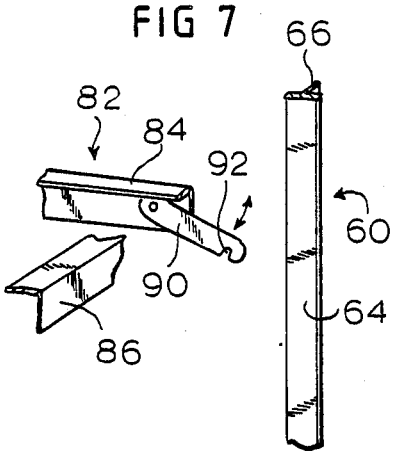
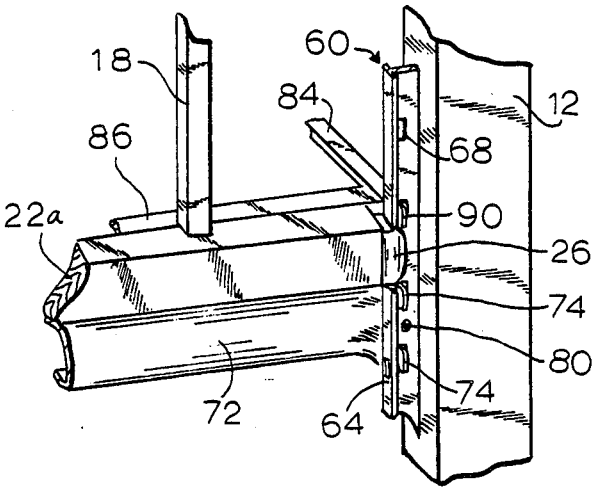
FIG.8
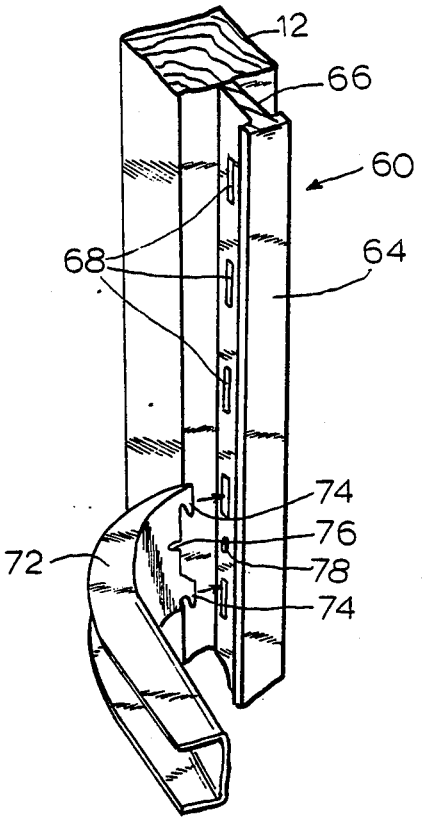
FIG.6

CRIB

BACKGROUND OF THE INVENTION

1. Field of the Invention

The field of the invention relates to a crib having a drop side.

2. Brief Description of the Prior Art

Drop side cribs are popular as they allow easy access to an infant when in the lowered position. When raised, the infant or child is safely retained within the sides and end boards of the crib.

A typical crib today includes four corner posts, one or two drop sides mounted to the posts, opposing head and footboards, a pair of stabilizing bars, and a spring hanger for supporting a mattress. The drop side is able to travel up or down along a pair of rods mounted to opposite posts. The rods each have an annular cross section and run parallel to the posts a selected distance therefrom. Openings are provided in the top and bottom rails of the drop sides for receiving the rods. A latch mechanism is provided for locking the drop side in the up position. The mechanism is operated by a foot pedal or lever, such as disclosed in U.S. Pat. No. 3,541,619, positioned beneath the spring hanger. To prevent accidental lowering, the drop side must be raised slightly before lowering can be accomplished. This prevents injury to a child who may crawl under the crib.

The stabilizing bars run longitudinally parallel to each other and are secured to the posts. They maintain the integrity of the crib while the other components are being maneuvered or assembled. The spring hanger is secured to the posts by four bracket assemblies. It may be positioned at any of several different elevations.

While the above-described crib offers both safety and reliability, consumers have occasionally found it to be somewhat difficult to assemble. It also includes a number of components which contribute to the complexity of the crib.

SUMMARY OF THE INVENTION

A crib having at least one drop side is provided. The crib is easy to assemble, very sturdy, and includes safety features for preventing injuries to infants and small children.

The drop side includes a top rail having a longitudinal slot therein and a bottom rail. Each end of the rails is secured to a vertical track mounted to each crib post. A pair of catch bars are positioned within the slot in the top rail and extend beyond the ends of the rail. Means are provided for moving the catch bars back and forth within the slot for engagement or disengagement with the vertical track.

In addition to retaining the drop side in the desired position, the track may also be used for mounting a spring hanger and a stabilizing bar. The track would then include two sets of slots running perpendicularly to each other, one set for receiving the catch bar ends, the other for receiving mounting means secured to the spring hanger and stabilizing bar, respectively.

BRIEF DESCRIPTION OF THE DRAWINGS

FIG. 6 is a perspective view of a track portion mounted to a crib post and an end of a stabilizing bar.

FIG. 7 is a perspective view of the track including portions of a spring hanger; and FIG. 8 is a perspective view of a lower portion of the crib.

DETAILED DESCRIPTION OF THE INVENTION

Figure 1:
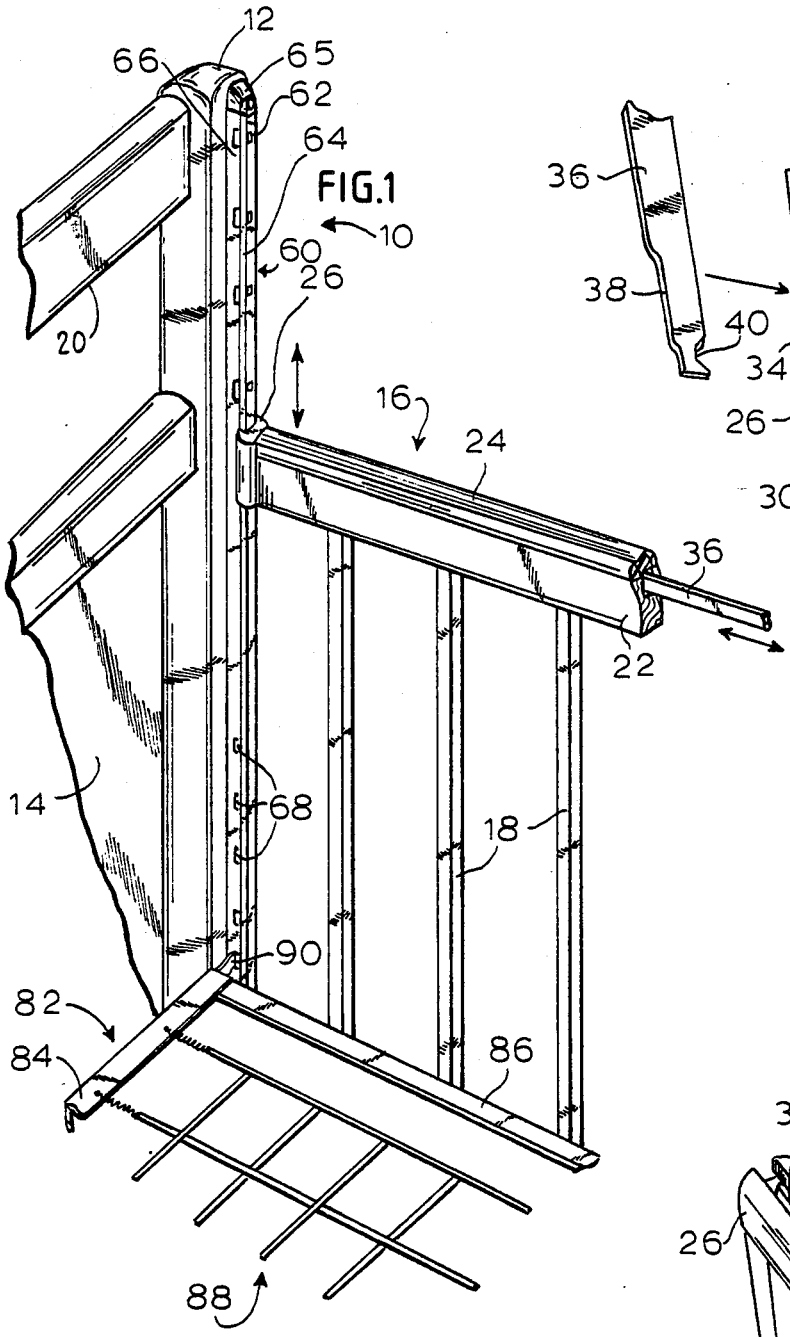
FIG. 1 is a perspective view of a top portion of a crib in accordance with the invention.

A crib 10 having four corner posts 12, front and rear panels 14, and at least one drop side 16 is provided by the invention. FIG. 1 illustrates one of the four substantially identical corner portions of the crib 10. The drop side 16 includes a plurality of spindles 18 which often have an ornamental appearance. Similarly, the front and rear panels are usually ornamental and may include a row of spindles (not shown) between the panel portion and top cross piece 20.

The drop side 16 of the crib 10 includes a top rail 22 and a bottom rail **22*a* connected by the spindles 18. A plastic teething rail 24 is mounted to the top rail 22. Each end of the top rail 22 has a nylon track follower 26 secured thereto by a wood screw 28, The track follower defines a T-shaped slot 30 therein. A slotted opening 32 runs perpendicularly to the slot 30** between the inner and outer walls of the track follower.

Figure 2:
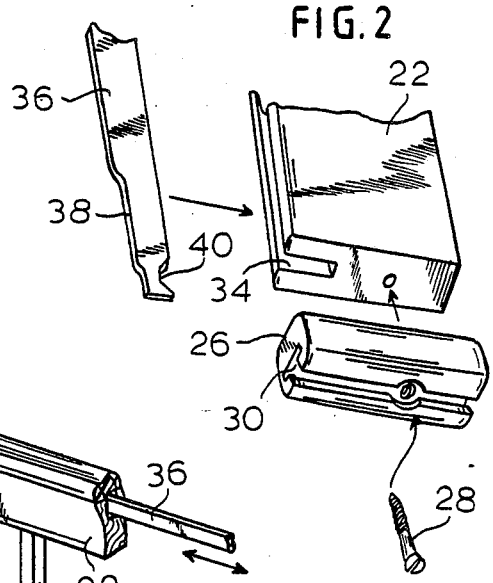
FIG. 2 is an exploded perspective view of an end of a drop side upper rail.
Figure 3:
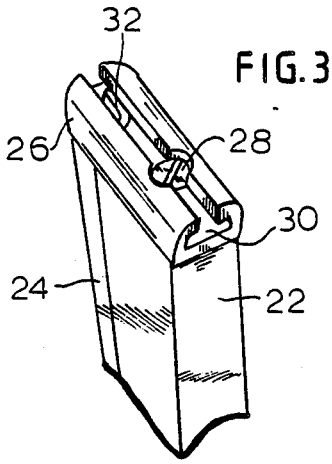
FIG. 3 is a perspective view of an end of a drop side upper rail.
Figure 5:
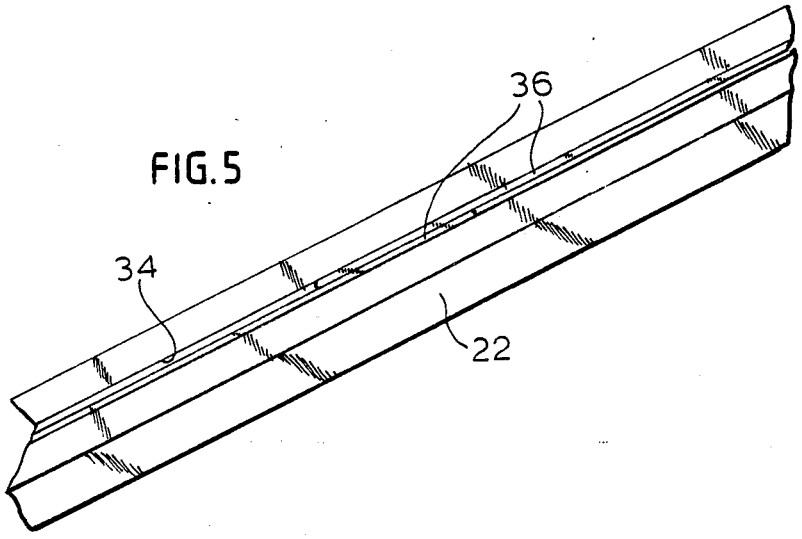
FIG. 5 is a top perspective view of the drop side upper rail.

A longitudinal groove 34 is provided within the center of the top rail 22. It is ordinarily hidden by the teething rail 24. A pair of catch bars 36 are positioned within the groove and overlap each other for a limited distance in the center portion of the top rail. Referring to FIG. 2, one end of the catch bar includes a relatively narrow portion 38 which passes through the slotted opening 32 in the track follower 26. A notch 40 is defined in the lower edge of this portion 38.

Figure 4:
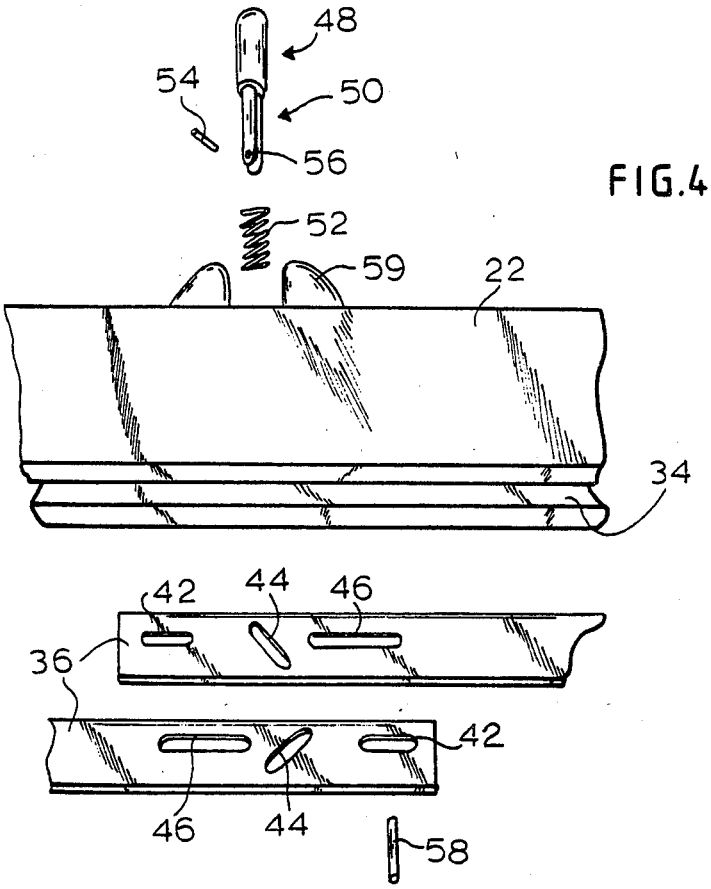
FIG. 4 is an exploded perspective view of a catch bar actuating mechanism.

The opposite ends of the catch bars are shown in FIG. 4 in conjunction with their operating mechanism. Each has a relatively short slot 42 near this end, a diagonal slot 44 adjacent thereto, and a relatively long slot 46 adjacent the diagonal. When mounted within the longitudinal groove 34 of the top rail 22, as shown in FIG. 4, the long slots will overlap the short slots and the diagonal slots will overlap each other.

A spring-mounted button 48 having a forked end 50 extends within the top rail 22 from the bottom surface thereof. A spring 52 is supported by the forked end and held in position by a retaining pin 54. The retaining pin passes through a pair of aligned holes 56 in the forked end of the button and the diagonal slots 44 within the catch bars. Due to the orientation of the diagonal slots, the spring and pin 54 urge the catch bars 36 in opposite directions and towards their narrow ends 38. A second retaining pin 58 extends through a relatively short slot and a relatively long slot of the catch bars and maintains the alignment thereof. The slotted openings 32 in the track followers also insure the catch bars stay in alignment. The button is made from nylon or any other material which will allow the catch bars to slide freely between the prongs defining its forked end. It is protected by a slotted member 59 affixed to the bottom surface of the top rail 22.

A T-shaped track 60 is affixed to each corner post 12. The track extends nearly the entire length of the post and has several functions. The top portion of the track includes at least one slot 62 within the face portion 64 thereof. The slot 62 penetrates the face portion and extends a short distance within the rear portion 66 of the track. In effect, two adjacent, perpendicular slots are created. The slot portion defined in the rear portion 66 of the track is somewhat longer than that extending through the face 64 thereof. This creates a small ledge which will fit within the notch 40 of the catch bar 36. When the catch bars 36 so engage the track, the drop side may be held in a desired vertical position. Stops 65 mounted at each end of the track prevent the drop side from being displaced therefrom.

The center portion of the track includes no slots. The bottom thereof includes a plurality of slots 68 extending through the rear portion 66 only. Referring to FIG. 6, two of these slots 68 are employed for receiving the notched end of a stabilizing bar 72. This end includes a pair of integral hooks 74 and a center notch 76. The hook engage the track within while the center notch 76 is aligned with a small hole 78 between adjacent slots 68. A screw 80 extends within the hole 78 and into the notch 76 to insure the stabilizing bar 72 is maintained in position.

The track 60 is also used for mounting a spring hanger 82 in a desired vertical position. The spring hanger 82 is used to support a mattress. It includes a pair of L-shaped lateral frame members 84 which are secured to and overlap the ends of a pair of L-shaped longitudinal frame members 86. The frame members 84, 86 support a grid 88 of conventional design.

As shown in FIG. 7, a lever 90 is pivotably mounted to each end of the lateral frame members 84. The longitudinal frame members do not contact the inner walls of the lateral frame members and thereby form a plurality of slots (not shown) which allow the levers 90 to extend outside the frame and pivot freely. Each lever includes a notch 92 near its outer end for engaging a slotted portion of the track 60. A plurality of slots 68 allow the spring hanger to be supported in a number of vertical positions. Lowering and raising the spring hanger 68 is accomplished more easily than with the conventional hook/ bracket constructions commonly employed today.

Assembly of the crib can be done quickly and confidently by the consumer. The stabilizing bars 72 are mounted to the tracks so that the front and rear panels 14 and corner posts 12 may be set in the upright positions. There is no mistaking which slots 68 to utilize since they must be adjacent the small hole 78. The screw 80 is then inserted with a screwdriver to insure the hooks 74 of the stabilizing bars 72 do not leave their respective slots.

By pivoting the levers 90 downwardly, there is sufficient space to maneuver the spring hanger 82 into position. The levers 90 are then swung outwardly to engage four slots 68 at the desired height.

The drop side 16 is guided onto the tracks 60 while pushing the button 48 in to withdraw the catch bars 36. The button may then be released and stops 65 affixed to the tops of the tracks 60.

Once assembled, the crib is both easy and safe to operate. Mattress height adjustments are made by raising the spring hanger 82 to withdraw the levers 90 from the slots 68. The levers are then reinserted into slots at a different height.

The drop side 16 can be maneuvered with only one hand due to the convenient mounting of the button 48. The user grips the center portion of the top rail 22 while exerting upward pressure thereon. By simultaneously squeezing the button; the catch bars 36 are caused to move toward the center of the rail and their ends 38 withdrawn from the slots 62. This movement results from the vertical movement of the retaining pin 54 within diagonal slots 44. By requiring the drop side 16 to be raised slightly to disengage the notches 40 of the catch bars 36 from the track, accidental lowering thereof by inadvertently pushing the button 48 is prevented. Member 59 also helps prevent unintended lowering as it requires one to intentionally place his finger within the slot therein to actuate the button. The button accordingly should not project farther from the rail than this member. Should an infant kick in the direction of the button, he will contact member 59 rather than actuate the drop side release mechanism.

While the track 60 is shown having a plurality of slots 62, only one is absolutely necessary for successful operation of the drop side 16. The upper slot 62 is used for the fully raised position. Downward movement of the drop side is restricted by stop members similar to those 65 mounted to the tops of the tracks. The other slots 62 allow the drop side to assume intermediate positions.

What is claimed is:

1. A crib comprising:

four corner posts;

first and second tracks secured, respectively, to two of said corner posts, each of said tracks including a set of first slots therein and a set of second slots therein, said sets of first and second slots within each track extending substantially perpendicularly to each other;

a drop side slidably mounted to said first and second tracks, said drops side including an upper rail extending between said tracks;

a groove defined within said upper rail and extending between said tracks;

first and second track engagement means positioned within said groove, said first and second track engagement means being catch bars, each of said catch bars including a notched end so that said drop side has to be raised slightly in order for said catch bars to be withdrawn from said first slots;

means for moving said catch bars in and out of engagement with said first slots within said first and second tracks, each of said catch bars including a diagonal slot and at least one longitudinal slot therein, said means for moving said catch bars including a first pin slidably mounted within said diagonal slots, means for moving said first pin in each of two directions, said at least one longitudinal slots within said catch bars at least partially overlapping each other, and a retaining pin extending through said longitudinal slots for maintaining alignment of said catch bars; and a spring hanger mounted to said first and second tracks, said spring hanger including mounting means extending within selected second slots within said track.

2. A crib as defined in claim1 including means for urging said catch bars in opposite directions and towards engagement with said respective first slots within said tracks.

3. A crib as defined in claim 2 wherein said first and second tracks each have a T-shaped configuration defining respective flat outer faces opposing each other and narrow rear portions connecting said respective flat outer faces with said two corner posts, respectively, said upper rail including first and second track followers mounted at each end thereof, said track followers each having a T-shaped slot therein.

4. A crib as defined in claim 3 wherein said first slots each have a first slot portion extending through one of said flat outer faces of said track and a second slot portion extending through one of said narrow rear portions thereof, said first and second slot portions of each first slot intersecting each other, said second slot portion of each track extending below said first slot portion thereof to define a ledge for engagement with one of said notched ends of said catch bars.

5. A crib as defined in claim 1 including a button extending within said upper rail, said button having a forked end defining opposing prongs, each of said catch bars passing through said opposing prongs, said first pin passing through said prongs and said diagonal slots in each of said catch bars.

6. A crib as defined in claim 5 including a spring urging said button away from said upper rail.

7. A crib as defined in claim 1 including a stabilizing bar mounted to said tracks.

8. A crib as defined in claim 7 wherein said stabilizing bar includes means for engaging said second slots within said first and second tracks.

9. A crib as defined in claim 8 wherein said stabilizing bar includes hooked end portions for engaging said second slots.

10. A crib as defined in claim 1 where said spring hanger includes a substantially rectangular frame supporting a grid, and a plurality of movable members mounted to said frame and releasably secured to said tracks.

11. A crib as defined in claim 1 wherein said drop side includes a lower rail extending between said tracks.

12. A crib comprising:

four corner posts;

a track secured to each of said corner posts, each of said tracks including at least one opening and one slot therein, said openings being in opposing relation to each other and running perpendicularly to said respective slots;

a drop side slidably mounted to said tracks, said drop side including an upper rail extending between said tracks, said rail having an upper surface and a groove defined within said upper surface and extending between said tracks;

a pair of elongate catch bars positioned within said groove, each of said catch bars including a first end portion engaging one of said openings within said tracks and a second end portion, said second end portions or said catch bars each including an elongate opening therein and overlapping each other such that said elongate openings also overlap each other;

a retaining pin extending through each of said elongate openings;

each of said second end portions including a slot therein extending diagonally therein with respect to said respective catch bars, said diagonal slots intersecting each other and extending in different direction;

a pin extending through both of said diagonal slots; and means for moving said pin in either of two directions whereby said catch bars are urged towards or away from the center of said groove.

* * * * *